United States Patent [19]

Cappotto

[11] 3,976,184

[45] Aug. 24, 1976

[54] RIBBON CARTRIDGE FOR DUAL AUTOMATIC TYPEWRITER FUNCTION

[75] Inventor: Samuel D. Cappotto, Syracuse, N.Y.

[73] Assignee: SCM Corporation, New York, N.Y.

[22] Filed: June 23, 1975

[21] Appl. No.: 589,729

[52] U.S. Cl. ..... 197/151; 197/181

[51] Int. Cl.[2] ..... B41J 33/02

[58] Field of Search ..... 197/82, 83, 91, 151, 197/168, 169, 181, 107, 6.7; 242/55, 57

[56] References Cited

UNITED STATES PATENTS

| | | | |
|---|---|---|---|
| 1,475,619 | 11/1923 | Barney | 197/51 |
| 1,608,279 | 11/1926 | Handley | 197/51 |
| 3,194,379 | 7/1965 | Szelvga | 197/151 |
| 3,204,746 | 9/1965 | Wolowitz | 197/181 X |
| 3,346,090 | 10/1967 | Goff et al. | 197/158 |
| 3,632,052 | 1/1972 | Read | 197/160 X |
| 3,637,060 | 1/1972 | McMahon | 197/6.7 |
| 3,643,778 | 2/1972 | Anderson | 197/151 |
| 3,729,081 | 4/1973 | Ozimek et al. | 197/181 X |
| 3,804,227 | 4/1964 | Cappotto et al. | 197/151 |
| 3,882,990 | 5/1975 | Genesio | 197/181 |
| 3,927,746 | 12/1975 | Wolowitz | 197/151 |
| 3,927,747 | 12/1975 | Wolowitz | 197/151 |
| 3,927,748 | 12/1975 | Wolowitz | 197/181 |
| 3,927,749 | 12/1975 | Wolowitz | 197/181 |

*Primary Examiner*—Edgar S. Burr
*Assistant Examiner*—Paul T. Sewell
*Attorney, Agent, or Firm*—Stanley J. Klem; Milton M. Wolson

[57] ABSTRACT

A typewriter ribbon cartridge having a camming abutment thereon for engaging one or more typewriter function responsive means to thereby actuate the typewriter function mechanism when the ribbon cartridge is inserted into the typewriter and thereafter to re-engage the responsive means to actuate the function mechanism a second time when the ribbon cartridge is removed from the typewriter.

8 Claims, 4 Drawing Figures

RIBBON CARTRIDGE FOR DUAL AUTOMATIC TYPEWRITER FUNCTION

BACKGROUND OF THE INVENTION

The present invention relates generally to insertable and removable typewriter ribbon cartridges of the type disclosed in U.S. Pat. No. 3,643,777 entitled TYPEWRITER RIBBON CARTRIDGE granted on Feb. 22, 1972 and U.S. Pat. application Ser. No. 150,946 filed June 9, 1971 entitled TYPEWRITER RIBBON CARTRIDGE both of which are assigned to the assignee of the instant application. The present application also represents an improvement over a simultaneously filed application entitled AUTOMATIC FUNCTION MECHANISM FOR TYPEWRITERS with Edwin Hurley as inventor in that the present application teaches the actuation of a backspace function upon insertion and removal of a cartridge and does not require the disabling of the escapement. The term "cartridge" as used hereinafter is defined to include any form of ribbon holder or container irrespective of configuration and the manner of insertion into the typewriter. The present invention cooperates with a typewriter borne mechanism that is clearly described in co-pending application entitled AUTOMATIC FUNCTION MECHANISM FOR TYPEWRITERS filed simultaneously with the instant application with Samuel D. Cappotto as sole inventor and assigned to the same assignee. The invention in its broadest aspects is not restricted to this cartridge structure, but has been illustrated and described for explanatory purposes and could readily be adapted to other cartridge housings. The ribbon cartridge of the present invention may include an error correction ribbon disposed therein whereby the correction ribbon is guided from the correction ribbon cartridge supply chamber along an integral ribbon guide arm that extends from the correction ribbon cartridge supply chamber to the typewriter print station. More specifically, the present invention is concerned with a ribbon cartridge construction that includes a camming abutment thereon to engage a backspace coupled responsive member when the ribbon cartridge is inserted into the typewriter thereby actuating the backspace mechanism to reposition the typewriter carriage to the print station. After the error is corrected, the ribbon cartridge is removed from the typewriter. As the ribbon cartridge is removed, the ribbon cartridge borne camming abutment engages the backspace coupled responsive member to reposition the typewriter carriage a second time to the proper print station where the correct character is to be typed.

One of the many useful applications of the invention resides in the provision of an error correction ribbon within the cartridge. The correction of errors in typewriters as disclosed in the prior art required a series of sequential manually manipulative operations so that the carriage of the typewriter may be backspaced a plurality of times to correct the error. For example, when an operator typed an erroneous character, it first became necessary to manually depress the backspace key thereby actuating the backspace mechanism to reposition the typewriter carriage to the proper print station for making the correction. After the erroneous typed character is removed by striking over the character through the correction ribbon, the backspace key was again manually depressed to actuate the backspace mechanism a second time. The typewriter carriage is repositioned to the proper printing station a second time and then the correct character is typed. Therefore, a series of manually manipulative operations by the operator were necessary to correct an erroneously typed character. The end result of the foregoing disadvantages of the prior art is that the typing speed is significantly reduced, total typing time is increased and the possibility of compounding the error by inadvertent multiple backspacing is increased.

The present invention overcomes the obvious disadvantages of the prior art in that the manual manipulation required to actuate the backspace mechanism and reposition the typewriter carriage to the proper print station is automatically accomplished just by inserting and removing the ribbon cartridge.

SUMMARY OF THE INVENTION

The inventive concept of the present invention contemplates a ribbon cartridge which is so structured that upon its insertion, it will actuate one or more typewriter functions and further upon its removal, it will actuate one or more typewriter functions a second time.

The term "typewriter function" is defined to include any typewriter operation which provides for the alignment of a selected platen impact point relative to the typewriter print point.

The basic inventive concept contemplated herein is directed to a typewriter cartridge having a means for actuating a typewriter function mechanism upon both insertion and removal thereof. Specifically embodied the present invention comprises a ribbon cartridge which includes an abutment that projects from one of the walls of the ribbon cartridge. The abutment defines a pair of divergent camming surfaces that engage a typewriter borne responsive camming lever which is coupled to the backspace mechanism within the typewriter. The camming surfaces are disposed on the ribbon cartridge wall in such a manner that they abut and actuate the camming lever within the typewriter as the ribbon cartridge is inserted and/or removed from the typewriter. Specifically, a first camming surface on the abutment progressively engages a first camming surface on the camming lever. The camming lever is urged to pivot and, being coupled to the backspace mechanism, actuates the backspace mechanism to reposition the typewriter carriage to the proper print station for correction of an erroneously typed character. As the ribbon cartridge is removed from the typewriter, a second cam surface on the abutment progressively engages a second cam surface on the camming lever. The camming lever is again urged to pivot and actuate the backspace mechanism a second time to reposition the typewriter carriage to the proper print station where the correct character is to be typed.

Although the physical embodiment of the invention disclosed herein has been directed to one application, namely error correction, it is clear that it could actuate a variety of typewriter functions, either singly or in combination.

Accordingly, it is an object of the present invention to provide a simple, inexpensive and reliable cartridge which upon insertion into a typewriter will automatically actuate one or more selected typewriter functions and which upon removal from the typewriter will actuate the function a second time.

Another object of the present invention is to provide a cartridge for a typewriter that will automatically actuate the backspace mechanism when the cartridge is both inserted into, and removed from the typewriter.

Another object of the present invention is to provide a simple and inexpensive means for adapting an existing cartridge to automatically activate the backspace mechanism of a typewriter.

Other objects, features, and advantages of the invention will become more apparent from the following description, including appended claims, and accompanying drawing.

DESCRIPTION OF THE PREFERRED EMBODIMENT

Although the inventive concept may be illustrated in conjunction with a variety of typewriter functions, the following embodiment has, for the purpose of clarity and ease of description, been confined to a common and readily employed function, namely, backspacing and error correction. The principle of this invention can be readily applied to other typewriter functions utilizing the embodiments described herein as an example.

Figure 1:
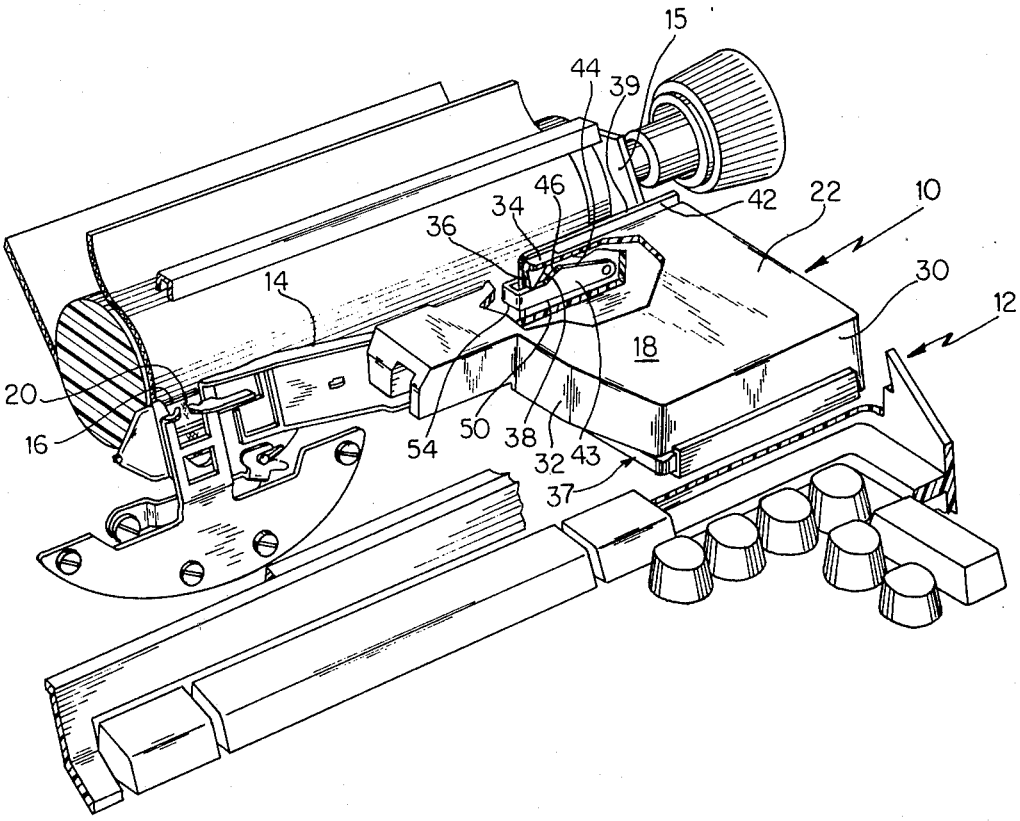
FIG. 1 is a perspective view of a portion of a typewriter having inserted therein a cartridge embodying the instant invention.
Figure 2:
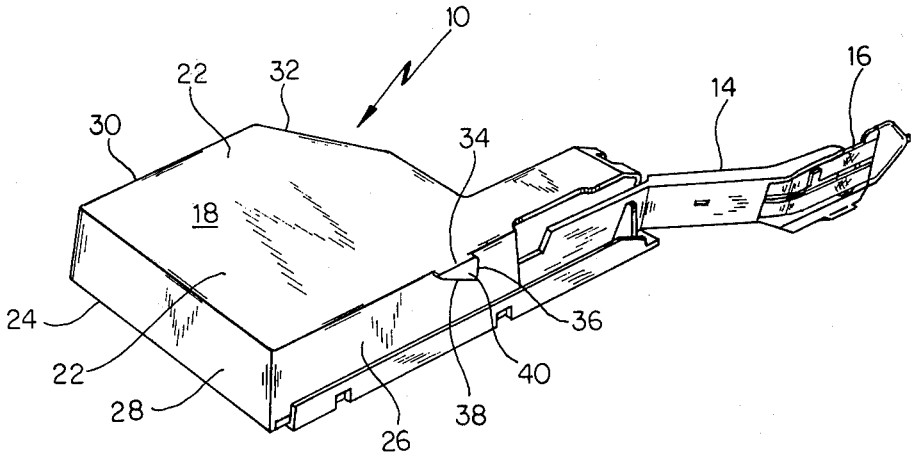
FIG. 2 is a rear perspective view of an embodiment of a ribbon cartridge made in accordance with the instant invention.

Referring now to the drawings and in particular to FIGS. 1 and 2 showing the ribbon cartridge 10 having an arm 14 extending therefrom, positioned in a typewriter 12. An error correction ribbon 16 is disposed in a housing 18 of ribbon cartridge 10 and guided along arm 14 to the typewriter print station 20 and then back to housing 18. The internal construction of ribbon cartridge 10 is fully described in the previously mentioned patents and patent applications, and is illustrative of one type of cartridge to which the inventive concept may be applied.

The ribbon cartridge housing 18 is comprised of a top 22 and a base 24 spaced from top 22 by depending walls 26, 28, 30, and 32.

The inventive concept as illustrated is applied in one particular embodiment to a specific cartridge for the sake of illustrative clarity and may take other forms as well as be adaptable to other types of cartridges.

Figure 3:
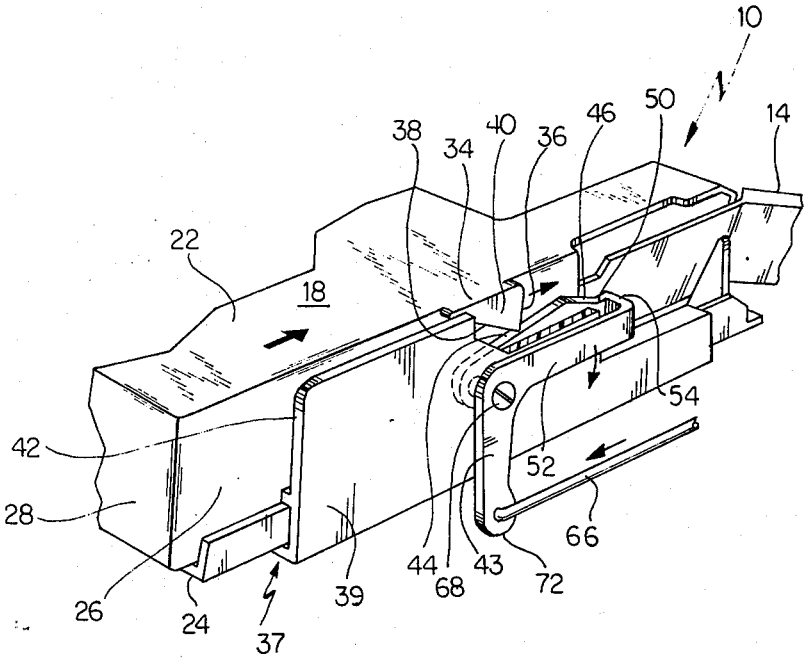
FIG. 3 is an enlarged rear perspective view of a portion of the ribbon cartridge as the cartridge is being inserted.
Figure 4:
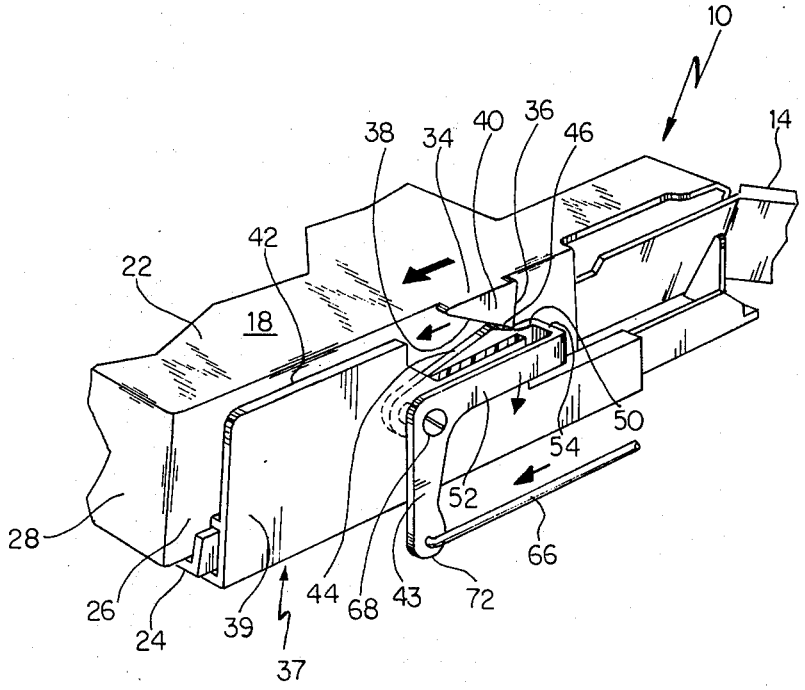
FIG. 4 is a view as shown in FIG. 3 with the ribbon cartridge as it is being removed.

Projecting from and disposed at the uppermost portion of wall 26 is an abutment 34 which is formed to provide oppositely directed cam surfaces 36 and 38. Abutment 34 projects outwardly from wall 26 to an extent that will permit sliding clearance between the abutment outer surface 40 and an inner surface 42 of a ribbon cartridge guide wall 39 of a ribbon cartridge platform 37 as shown in FIGS. 1, 3, and 4. One appropriate typewriter ribbon cartridge platform 37 is fully disclosed in the aforementioned co-pending application entitled AUTOMATIC FUNCTION MECHANISM FOR TYPEWRITERS. In other words, there must be sufficient clearance between the abutment outer surface 40 and inner surface 42 of guide wall 39 to readily permit unrestricted insertion of ribbon cartridge 10 into typewriter 12. Projecting abutment 34 is further positioned on ribbon cartridge wall 26 whereby its camming surfaces 36 and 38 are in actuable alignment with camming surfaces 44 and 46 of a typewriter borne camming lever 43 when ribbon cartridge 10 is being inserted into and removed from the typewriter. Typewriter 12 is provided with means for actuating its backspace function that may be disposed proximate the opening that receives the ribbon cartridge and in the path of means associated with the ribbon cartridge to actuate the same, most clearly shown in FIGS. 3 and 4. One such actuating means which has been found to operate satisfactorily includes a U-shaped camming lever 43 that is pivotally supported on a stud 68. The stud 68 passes through one arm 52, through guide wall 39 and terminates in the opposite arm 50. Arms 50 and 52 are connected at their base 54 and are disposed on opposite sides of and adjacent to guide wall 39. The upper edge of arm 50 is contoured to define a first cam surface 44 and an adjacent second cam surface 46. Cam surfaces 44 and 46 are sloped in opposite directions for bidirectional engagement with cam surfaces 36 and 38 of abutment 34. Cam lever 43 is coupled to the backspace mechanism by means of depending arm 72, link 66 and a coupling mechanism that is fully disclosed in the co-pending application mentioned above.

When an error correction operation is desired, error correction ribbon cartridge 10 is inserted into typewriter 12. As ribbon cartridge 10 is progressively inserted into typewriter 12, abutment cam surface 36 engages first cam surface 44 of cam lever 43 thereby activating the typewriter backspace mechanism. The backspace mechanism is activated when cam lever 43 is displaced downward by cam surface 38 engaging cam lever surface 44. Upon backspacing, typewriter carriage 15 is repositioned to its previous letter space position whereby the erroneous typed character may be rendered semi-invisible by striking through correction ribbon 16. As error correction ribbon cartridge 10 is thereafter removed from the typewriter, abutment cam surface 38 progressively engages second cam surface 46 of cam lever 43 thereby actuating the typewriter backspace mechanism a second time. The backspace mechanism is actuated when cam lever 43 is again displaced downward by abutment cam surface 36 as it engages cam surface 46. Typewriter carriage 15 is again repositioned to its previous letter space position. Upon insertion of a printing ribbon cartridge that is not provided with a backspacing actuator or abutment, the correct character may be typed.

Although the illustrated embodiment has been shown and disclosed with an abutment that automatically actuates a typewriter backspace function, it is clear that the abutment may be employed to actuate other related functions.

It can be seen from the foregoing description that camming abutment 34 on error correction ribbon cartridge 10 engages an actuating mechanism to automatically backspace the typewriter carriage 15 when the error correction ribbon cartridge 10 is inserted into typewriter 12 and to engage the actuating mechanism a second time to automatically backspace the typewriter carriage 15 a second time when error correction ribbon cartridge 10 is removed from the typewriter. The instant invention thereby eliminates the necessity of multiple manual manipulative steps that are now necessary to correct an erroneously typed character.

Although the cooperating cartridge abutment 40 and the typewriter responsive lever 43 have been illustrated in vertical orientation and specifically positioned, it is clear that they may readily assume other locations and orientations provided that they lie in a common path. In addition, it should be borne in mind that the term "abutment" is not intended to be restrictively defined and can include any cartridge surface whether projecting or otherwise.

While the foregoing description has shown and described the fundamental novel features as applied to a preferred embodiment, it will be understood by those skilled in the art that modifications embodied in various forms may be made without departing from the spirit and scope of the invention.

What is claimed is:

1. A cartridge for a typewriter, which typewriter includes means for receiving the cartridge and operational means to perform a typewriter function for causing the alignment of a selected platen impact point relative to the typewriter print point, the cartridge comprising:

means disposed on the cartridge for actuating the typewriter operational means to thereby perform the typewriter function upon insertion and again upon removal of the cartridge.

2. A cartridge as defined in claim 1 wherein said actuating means includes an abutment carried by the cartridge.

3. A cartridge as defined in claim 2 wherein said abutment is in the path of said operational means for actuating the typewriter function upon insertion and removal of the cartridge.

4. An automatic backspacing ribbon cartridge for a typewriter having a traversable carriage, a fixed ribbon cartridge platform for supporting and guiding the ribbon cartridge to the typewriter print station when the ribbon cartridge is inserted into the typewriter; an actuating mechanism pivotally supported on the ribbon cartridge platform, and a backspace mechanism responsive to the actuating mechanism for incrementally reversing the forward traverse of the carriage, the ribbon cartridge comprising:

an abutment on the ribbon cartridge, the abutment including a plurality of camming surfaces for engaging the actuating mechanism for actuating the typewriter backspace mechanism when the ribbon cartridge is inserted into and removed from the typewriter.

5. An automatic backspacing ribbon cartridge as defined in claim 4 wherein said abutment includes a first cam surface for actuating the backspace mechanism when the ribbon cartridge is inserted into the typewriter and a second cam surface for actuating the backspace mechanism when the ribbon cartridge is removed from the typewriter.

6. An automatic backspacing ribbon cartridge as defined in claim 5 wherein said abutment is carried by the ribbon cartridge in a substantially vertical orientation and wherein said first and second cam surfaces are disposed on the lowermost portion of said abutment.

7. An automatic backspacing ribbon cartridge as defined in claim 6 wherein said abutment projects from a housing wall of the ribbon cartridge.

8. An automatic backspacing ribbon cartridge as defined in claim 6 wherein said first and second surfaces are sloped opposite one another for bidirectional actuating of said backspace mechanism.

* * * * *